US008925452B2

(12) United States Patent
Ching

(10) Patent No.: US 8,925,452 B2
(45) Date of Patent: Jan. 6, 2015

(54) HAND-HELD MACHINE PRESS APPARATUS

(75) Inventor: Min-An Ching, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 491 days.

(21) Appl. No.: 13/198,427

(22) Filed: Aug. 4, 2011

(65) Prior Publication Data

US 2012/0167788 A1 Jul. 5, 2012

(30) Foreign Application Priority Data

Dec. 31, 2010 (TW) ..... 99225647 U

(51) Int. Cl.
*B30B 1/38* (2006.01)

(52) U.S. Cl.
CPC ..... *B30B 1/38* (2013.01)
USPC ..... 100/269.01; 100/269.14; 100/269.16

(58) Field of Classification Search
USPC ..... 100/43, 48, 50, 51, 52, 269.01, 269.05, 100/269.14, 269.15, 269.16, 269.18
See application file for complete search history.

(56) References Cited

U.S. PATENT DOCUMENTS 3,323,535 A * 6/1967 Klemm et al. ..... 137/110
4,489,649 A * 12/1984 Daugherty ..... 100/215
5,852,868 A * 12/1998 Soriano ..... 29/753
7,114,436 B1 * 10/2006 Mueller ..... 100/347

* cited by examiner

*Primary Examiner* — Jimmy T Nguyen
(74) *Attorney, Agent, or Firm* — Novak Druce Connolly Bove + Quigg LLP

(57) ABSTRACT

A hand-held pressing apparatus comprises a pressing assembly and a controlling valve. The pressing assembly comprises a piston cylinder, a piston, a piston rod mounted on the piston, and a tool. The piston cylinder defines a piston chamber. The piston is slidably received in the piston chamber. The piston rod is partially protrudes from the piston chamber. The tool is mounted to the protruding end of the piston rod. The controlling valve connects to a pressure source, and is for controlling the gas pressure in the piston chamber. When the pressing head aims at the workpiece, the controlling valve controls the piston chamber to pressurize the pressure cylinder assembly using pressurized gas from the pressure source, to drive the piston, the push rod and the tool to act on the workpiece.

1 Claim, 2 Drawing Sheets

HAND-HELD MACHINE PRESS APPARATUS

BACKGROUND

1. Technical Field

The present disclosure relates to press apparatuses, and particularly to a hand-held machine press apparatus.

2. Description of Related Art

Generally, many machine presses are fixed in one location due to their large size and weight, so that workpieces can be shaped using a great deal of pressure. However, not all workpieces need such a great amount of pressure to be shaped. It is inconvenient and a waste of power to use the large machine press for such workpieces. Further, because the presses are fixed in place, all workpieces big and small must be brought to the press to be shaped, which is inconvenient.

Therefore, there is room for improvement within the art.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
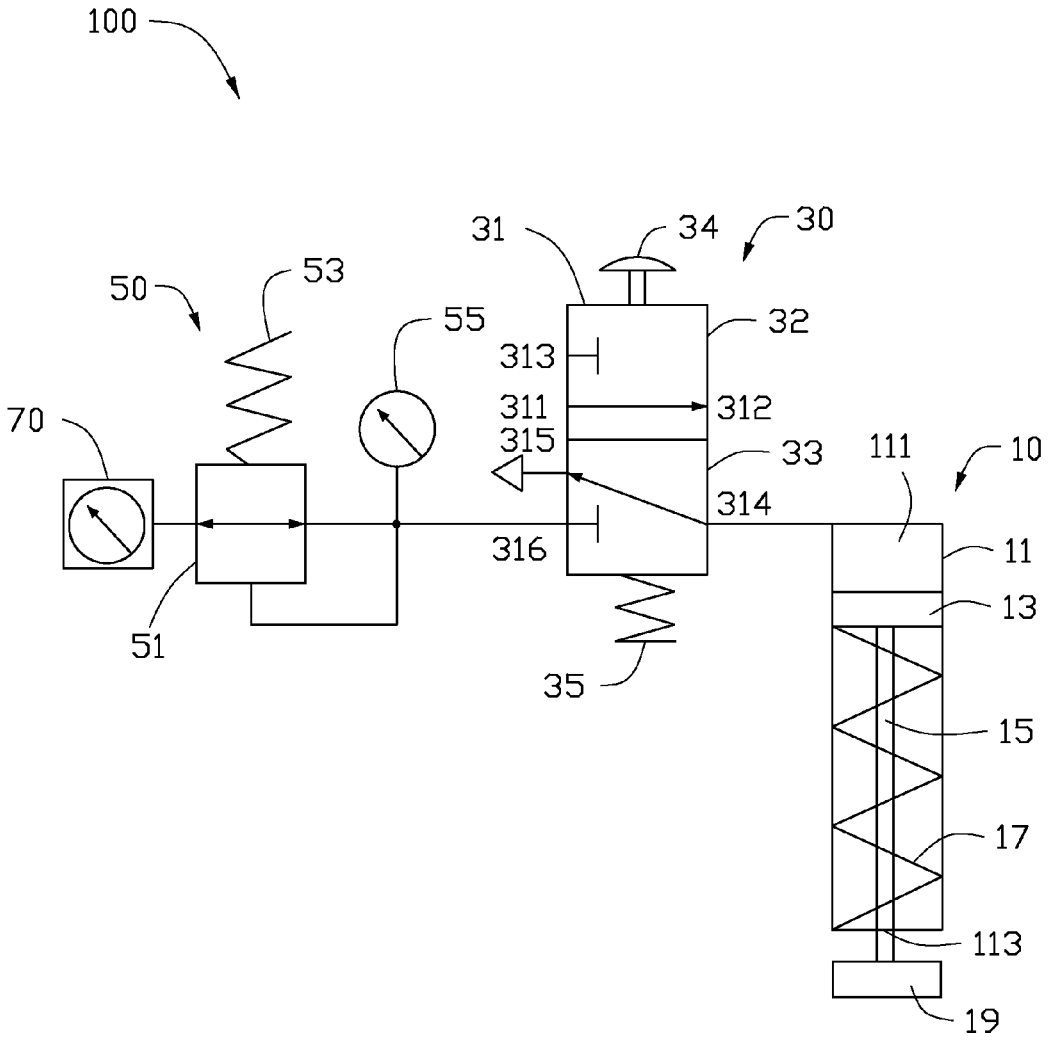
FIG. 1 is a schematic view of one embodiment of a pressing apparatus, according to a first state.
Figure 2:
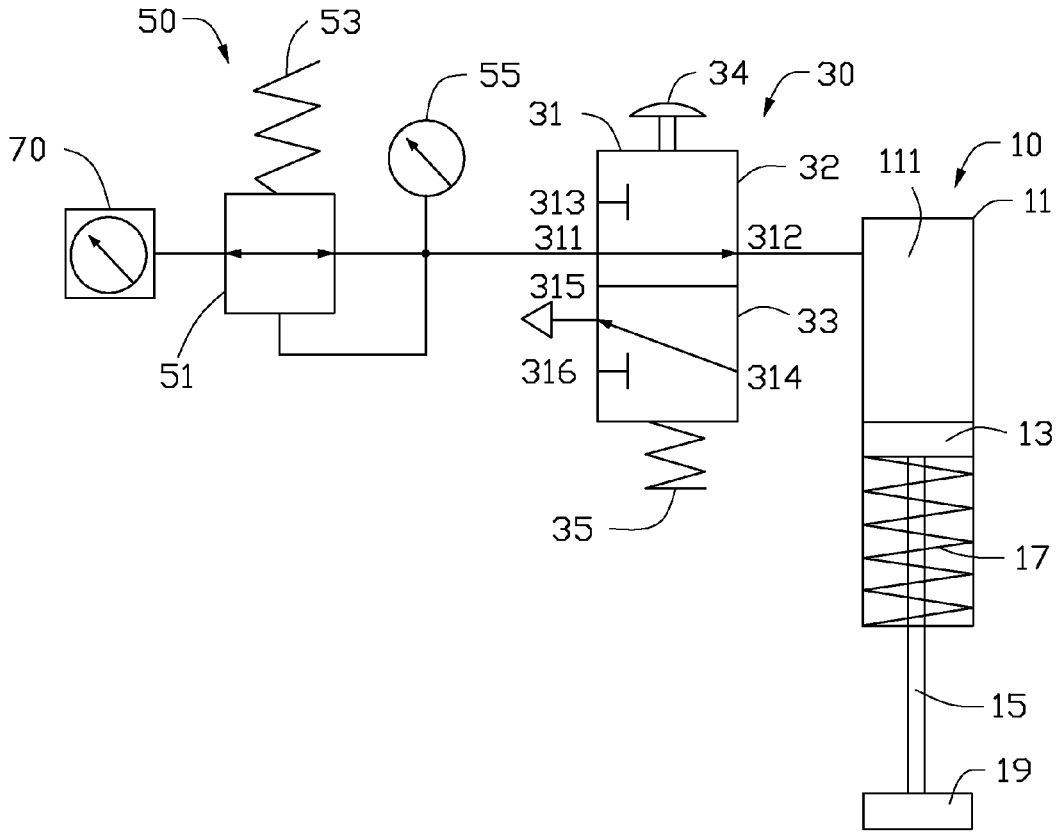
FIG. 2 is a schematic view of the pressing apparatus of FIG. 1, according to a second state.

FIGS. 1 and 2 show a schematic view of a hand-held machine press apparatus 100 of an exemplary embodiment and in first and second flow paths (further described below), respectively. The actual device represented by the schematic view of the pressing apparatus 100 is sized to be portable, i.e., moved, held and used from place-to-place as needed, by an operator himself without external support such as lift or crane, and includes a pressing assembly 10 and a controlling valve 30.

The pressing assembly 10 includes a generally standard pneumatic cylinder assembly including a piston cylinder 11, a piston 13, a piston rod 15 partially protruding from the cylinder 11, and an elastic member 17. A tool, such as a pressing head 19 is removably attachable to the end of the piston rod 15 protruding from the piston cylinder 11, and for pressing and shaping workpieces or be changed to some other tool.

The piston cylinder 11 defines a piston chamber 111 and a through hole 113 communicating with the piston chamber 111. The piston chamber 111 connects to the pressure source 70, and receives the piston 13, the piston rod 15, and the elastic member 17. And the piston rod 15 protrudes from the piston cylinder 11 through the through hole 113.

The elastic member 17 may be coiled around the portion of the piston rod 15, which is for restoring both the piston 13 and the piston rod 15 to an original flow path after the piston 13 and the rod 15 have been driven by gas pressure to operate the pressing head 19. In this exemplary embodiment, the elastic member 17 is a coil spring but can be some other elastic portion in other embodiments and may even include a gas spring.

The controlling valve 30 includes a gas path control valve 31 connected between the pressure source 70 and the piston cylinder 11, which is for controlling gas pressure in the piston cylinder 11. In this exemplary embodiment, the controlling valve 30 is a two-flow path three-way valve, that further includes a first flow path 32, a second flow path 33, and a switch 34. The switch 34 controls whether the controlling valve 30 opens the first flow path 32 or the second flow path 33 and therefore controls the flow-path of the air supply under pressure (i.e., the first or second flow path) to the piston cylinder 11. When the switch 34 is set to close the first flow path, e.g., cut off the air supply, and gas in the piston cylinder 11 is vented to atmospheric until the internal pressure is equalized with outside pressure.

The gas path control valve 31 defines a first gas inlet 311, a first gas outlet 312, a first sealed port 313, a second gas inlet 314, a second gas outlet 315, and a second sealed port 316. Both the first sealed port 313 and the second sealed port 316 remain sealed.

Referring back to FIG. 2, in the first flow path 32, the first gas inlet 311 is connected to the pressure source 70 (containing a pressurized gas such from the pressure source 70 flows through the first gas inlet 311 and the first gas outlet 312 to the piston chamber 111).

Referring back to FIG. 1, in the second flow path 33, the second gas inlet 314 is connected to the piston chamber 111, the second gas outlet 315 is open, and the pressure source 70 is connected to the second sealed port 316 which keeps sealed. So that the pressure source 70 can not supply air to the piston chamber 111, furthermore, the air in the piston chamber 111 is escaped through the second gas inlet 314 and the second gas outlet 315, until the gas pressure in the piston chamber 111 is equalized with outside pressure.

In other words, to press and shape the workpiece, the switch 34 is first pressed to switch the pressing assembly 10 to the first flow path 32, and to supply gas pressure and cause the pressing head 19 to press the workpiece. Then the switch 34 is pressed again to switch the pressing assembly 10 to the second flow path 33, and to relieve the gas pressure at which time the elastic member 17 restores the piston 13 and the rod 15 to their original flow path which removes the pressing head 19 from the workpiece. In this exemplary embodiment, the controlling valve 30 further includes an elastic portion 35, which is for being deformed when the switch 34 is first pressed, and restore the controlling valve 30 to the second flow path 33 when the switch 34 is pressed again.

In this exemplary embodiment, the pressing apparatus 100 further includes an adjusting valve 50 connected between the pressure source 70 and the controlling valve 30, and is for adjusting the gas flow rate from the pressure source 70 to the controlling valve 11. So that the controlling valve 11 can press and shape workpieces with a corresponding force. The adjusting valve 50 includes a pipeline 51, an adjusting member 53 and an indicator gauge 55. The pipeline 51 is connected between the pressure source 70 and the gas path control valve 31, which is for delivering the gas from the pressure source 70 to the gas path control valve 31. The adjusting member 53 can be operated to partially extend into the pipeline 51. So that the gas flow rate to the controlling valve 11 can be changed according to operating the adjusting member 53 to a different position in the pipeline 51. The indicator gauge 55 communicating with the pipeline 51, which is for indicating current parameters, such as the gas flow rate through the pipeline 51 to the piston cylinder 11.

In assembly, the controlling valve 30 is connected to the piston cylinder 11, the adjusting valve 50 is connected between the pressure source 70 and the piston cylinder 11. And the controlling valve 30 opens the first flow path 32.

FIG. 2 shows a pressing apparatus 100 of one embodiment, according to the piston cylinder 11 is pressurized to press and shape a workpiece according to steps provided below.

First, a pressing head 19 is mounted on the end of the piston rod 15.

Second, the adjusting valve 50 is set to the desired gas pressure according to what is needed to shape the workpiece.

Third, the switch 34 is pressed to set the controlling valve 30 in the first flow path 32. So that the piston chamber 111 is pressurized to drive the pressing head 19 to press and shape the workpiece.

Finally, the switch 34 is pressed again, so that the elastic portion 35 can restore the controlling valve 30 to the second flow path 33. Thereafter the pressing head 19 can be restored and move away from the workpiece after pressing.

It's to be understood that the controlling valve 30 and the adjusting valve 50 can be spaced from each other, or both positioned on the pressing assembly 10. The adjusting valve 50 connects to the pressure source 70 via gas hoses (not shown), which makes it's more convenient to hold and operate the pressing assembly 10 to press workpieces.

In this exemplary embodiment of pressing apparatus 100 can be held by an operator himself without external support. And the pressing head 19 can be disengaged from the pressing assembly 30, to switch to some other type of pressing heads or tools according to need. In other embodiments, if the amount of pressure needed to properly shape a workpiece is too great for a hand held press machine such as the apparatus 100, a larger size apparatus 100, but still smaller and lighter than conventional machine presses, may be employed that can be wheeled about on a cart. In conclusion, the exemplary embodiment of pressing apparatus 100 has simple structure, and is light and portable, and convenient to operate.

Although one embodiment of the present disclosure has been specifically described, the present disclosure is not to be construed as being limited thereto. Various changes or modifications may be made to the present disclosure without departing from the scope and spirit of the present disclosure.

What is claimed is:

1. A hand-held machine pressing apparatus for pressing workpieces supported on a supporting surface, comprising:

a pressing assembly, comprising:

a piston cylinder defining a piston chamber;

a piston slidably received in the piston chamber, and can be driven by gas pressure in the piston chamber;

a piston rod mounted on the piston, partially protruding from the piston cylinder; and a tool removably attachable to the end of the piston rod protruding from the piston cylinder, for pressing and shaping the workpiece; and a controlling valve which connecting to a pressure source, for controlling the gas pressure in the piston chamber; wherein the pressing head aims at the workpiece, the controlling valve controlling the piston chamber to pressurize the pressure cylinder assembly using pressurized gas from the pressure source, to drive the piston, the push rod and the tool to act on the workpiece; and wherein the controlling valve comprises a first flow path, a second flow path, and a switch, the switch controls the controlling valve to open the first flow path to supply the gas pressure to the piston chamber, or to open the second flow path to relieve the gas pressure in the piston chamber; and wherein when the controlling valve opens the first flow path, the piston cylinder is pressurized to drive the tool to act on the workpiece; when the controlling valve opens the second flow path, the tool moves away from the workpiece, the controlling valve further includes a gas path control valve, the controlling valve connects to the pressure source via the gas path control valve, which includes a first gas inlet, a first gas outlet, a first sealed port, a second gas inlet, a second gas outlet, and a second sealed port, both the first sealed port and the second sealed port keep sealed, when the controlling valve opens the second flow path, the second gas inlet is connected to the piston chamber, the second gas outlet is open, and the pressure source is connected to the second sealed port, the gas in the piston chamber is escaped through the second gas inlet and the second gas outlet.

* * * * *